United States Patent [19]

Robbins

[11] Patent Number: 5,042,716

[45] Date of Patent: Aug. 27, 1991

[54] PIVOTABLE MAILBOX AND POST ASSEMBLY

[75] Inventor: E. Stanley Robbins, Killen, Ala.

[73] Assignee: Robbins Industries, Inc., Florence, Ala.

[21] Appl. No.: 516,465

[22] Filed: Apr. 30, 1990

Related U.S. Application Data

[63] Continuation-in-part of Ser. No. 398,914, Aug. 28, 1989, Pat. No. 4,932,587.

[51] Int. Cl.[5] ..... B65D 91/00

[52] U.S. Cl. ..... 232/39; 248/133; 248/160

[58] Field of Search ..... 232/39; 248/160, 133, 248/145.6

[56] References Cited

U.S. PATENT DOCUMENTS

| | | | |
|---|---|---|---|
| 884,105 | 4/1908 | Ryerson et al. | 232/39 X |
| 1,030,391 | 6/1912 | Davis | 232/39 X |
| 1,958,677 | 5/1934 | Phillips | 232/39 X |
| 2,911,174 | 11/1959 | Goss | 248/160 |
| 4,792,088 | 12/1988 | Bonnell | 248/160 X |
| 4,821,952 | 4/1989 | Deciutiis | 232/39 X |
| 4,865,288 | 9/1989 | Dicke et al. | 248/160 X |

*Primary Examiner*—Robert W. Gibson, Jr.
*Attorney, Agent, or Firm*—Phillips & Beumer

[57] ABSTRACT

A rural mailbox and post assembly enabling the front end of the mailbox to be pulled forward and up to or inside a window of a motor vehicle for retrieval of the mail. The post is made up of upper and lower portions, pivotally joined so that the upper portion may be pulled forward around a pivot pin at the top of the lower portion, which is affixed to the ground or a base. Biasing means such as a spring is provided to maintain the upper post and attached box in upright position until pulled forward. When the box is released, the spring urges the box back into upright position. A handle at the front of the box enables it to be grasped and pulled from within the vehicle.

7 Claims, 3 Drawing Sheets

PIVOTABLE MAILBOX AND POST ASSEMBLY

CROSS REFERENCE OF RELATED APPLICATION

This application is a continuation-in-part of application Ser. No. 398,914, filed Aug. 28, 1989, now U.S. Pat. No. 4,932,587 issued 6-12-90.

TECHNICAL FIELD

This invention relates generally to mailboxes and more particularly to rural mailboxes provided with mail retrieval mechanisms.

BACKGROUND OF THE INVENTION

Retrieval of mail from rural mailboxes presents difficulty to the driver of a vehicle in that a long and awkward reach to the back of the box may be required. In the case of smaller standard sizes of mailbox made in accordance with standards of the United States Postal Service, larger pieces of mail such as magazines and catalogs tend to become lodged against sides of the box so that they do not slide out freely but require manipulation for their removal. In the process of loosening such pieces of mail, smaller pieces such as letters may fall to the ground, requiring the driver of the vehicle to step out of the vehicle to retrieve them. Various approaches to providing for easier retrieval of mail from mailboxes are disclosed in prior art patents. U.S. Pat. No. 4,714,192, issued Dec. 22, 1987, to Harlow et al.; U.S. Pat. No. 4,121,758, issued Feb. 23, 1977, to Bonner; and U.S. Pat. No. 3,606,140, issued Sept. 20, 1987, to Shanahan, disclose use of slidable mail-holding trays that may be pulled forward when the door is open to bring the mail within reach. Extendible, forwardly-sliding components that are nested or telescoped within a mailbox are disclosed in U.S. Pat. No. 3,163,356, issued Dec. 29, 1964, to Joehnk; U.S. Pat. No. 2,718,964, issued Feb. 19, 1957, to Ledgewood; and U.S. Pat. No. 1,992,640, issued Feb. 26, 1935, to Steen. U.S. Pat. No. 4,160,520, issued July 10, 1979, to Cluthe, shows a mailbox having a slidable tray within the enclosure and a transverse hinge spaced a considerable distance away from the front of the box. Upon sliding the tray until the hinge reaches the front end of the box, the door, and the front part of the tray which is integral with the door, are tiltable downward. The devices disclosed in these patents exhibit disadvantages in their complexity and varying degrees of incompatibility with standard rural mailboxes. Mailbox posts that are made into sections joined by a strong spring are known in the prior art such as shown in "Builder's Square" sales catalog, February 1990, at page 18. The "spring-back" post shown therein is not suitable for being forward by hand for retrieving mail but rather is made to enable the post to yield and spring back when hit by an automobile bumper. A handle for pulling the box forward is not shown or suggested for use in combination with such post.

My co-pending application Ser. No. 398,914, filed Aug. 28, 1989, is directed to a mailbox assembly which includes a horizontally disposed mail-supporting member which may be the bottom of the box itself or an insertable tray. The mail-supporting member is arranged to be tilted around a transverse axis so that the rear thereof will be placed at an elevated position with respect to the front, causing the mail to slide downward and outward into a mail-catching wall associated with the mailbox door. Mailboxes embodying this invention are effective for larger sized boxes, but for smaller sizes, in particular, the most widely used smallest size of rural mailbox, the sliding motion required to propel the mail downward and outward into the catching area may be defeated by the lodging of larger mail articles against sides of the box, thus requiring reaching into the box to retrieve such articles. It is desired to provide a mailbox assembly so constructed as to allow the front end of the box to be brought into position inside an open window of an automobile vehicle, with the box rear end higher than the front so that smaller pieces of mail will slide downward into the car and larger pieces may be readily removed by the driver or passenger in the vehicle without undue reaching or stepping out of the car.

SUMMARY OF THE INVENTION

This invention is concerned with a mailbox and post assembly that has an upper portion of the post pivotally secured to a fixed lower portion so that the upper portion and a mailbox secured to its top may be pulled forward and downward to project the front end of the box into an open window of a motor vehicle located a predetermined distance away from the box and post. A handle secured to and projecting forward from the box may be provided to facilitate grasping the box for pulling forward. The juncture region between upper and lower portions of the post may include a transverse pivot pin arranged to allow the upper portion to be moved so as to project the box forward and a spring that baises the upper portion into a normally upright position, the strength of the spring being selected to enable the box to be readily moved forward and smoothly returned to its normal upright position.

The arrangement provided by this invention does not entail any additions or modifications to a standard mailbox or to its being conventionally mounted onto the top of a post except that a projecting handle secured to the box may be included to enable easier grasping for pulling the box forward. The invention is particularly applicable to small mailboxes where larger pieces of mail may become lodged and require reaching inside the box to be dislodged. Raising of the flag on the mailbox without undue reaching is also facilitated by this invention.

It is, therefore, an object of this invention to provide a mailbox and post assembly that enables the front end of the box to be pulled forward into an open window of a motor vehicle.

Another object is to provide a mailbox and post assembly that facilitates removal of mail from the box by a rider of a motor vehicle without undue reaching.

Another object is to provide for such an assembly that prevents mail from being dropped to the ground while being retrieved by a rider of a motor vehicle.

Other objects and advantages of the invention will be apparent from the following detailed description taken in conjunction with the accompanying drawings.

DESCRIPTION OF THE PREFERRED EMBODIMENT

Figure 1:
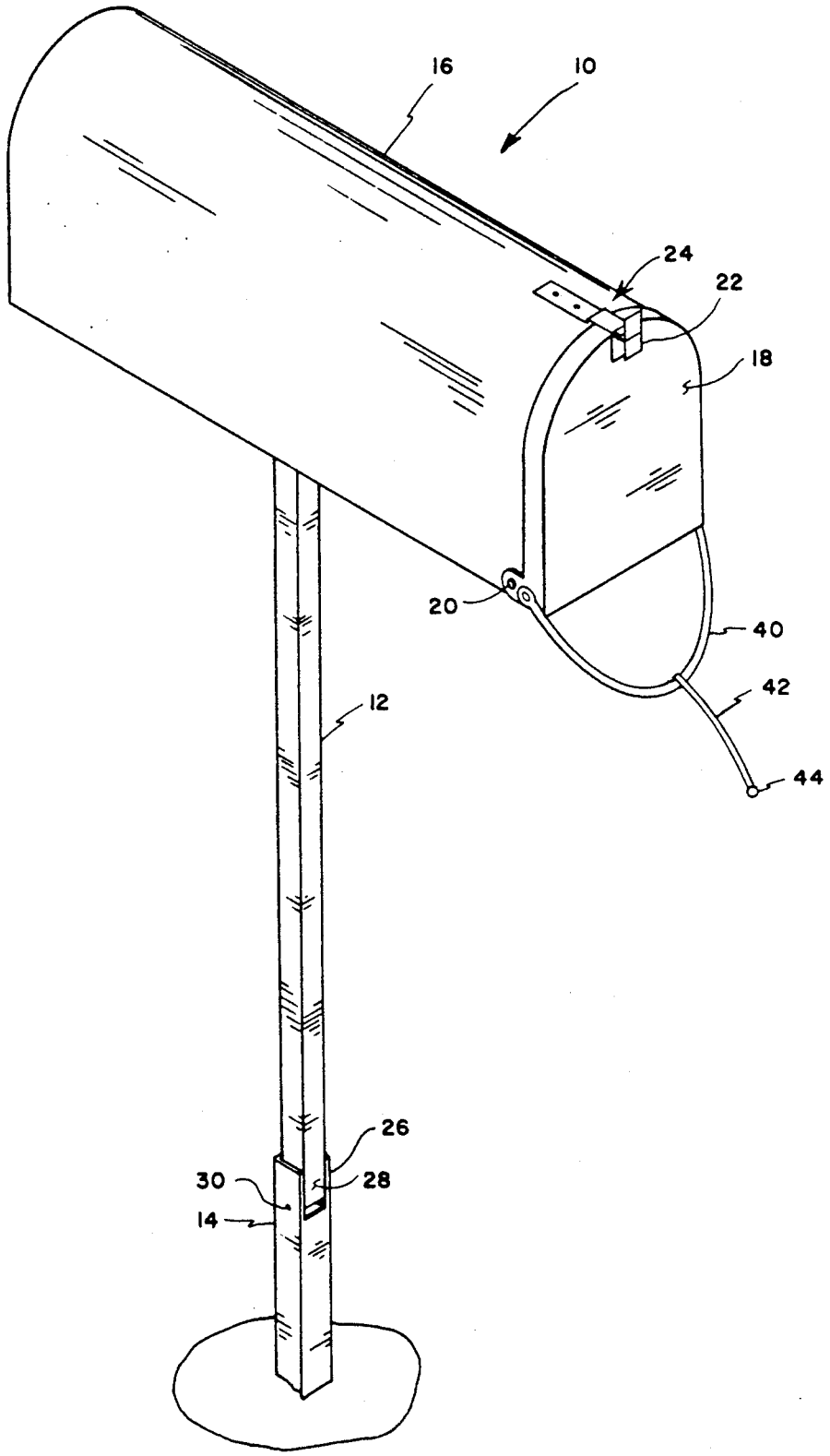
FIG. 1 is a pictorial view showing a mailbox and post assembly embodying the invention.
Figure 2:
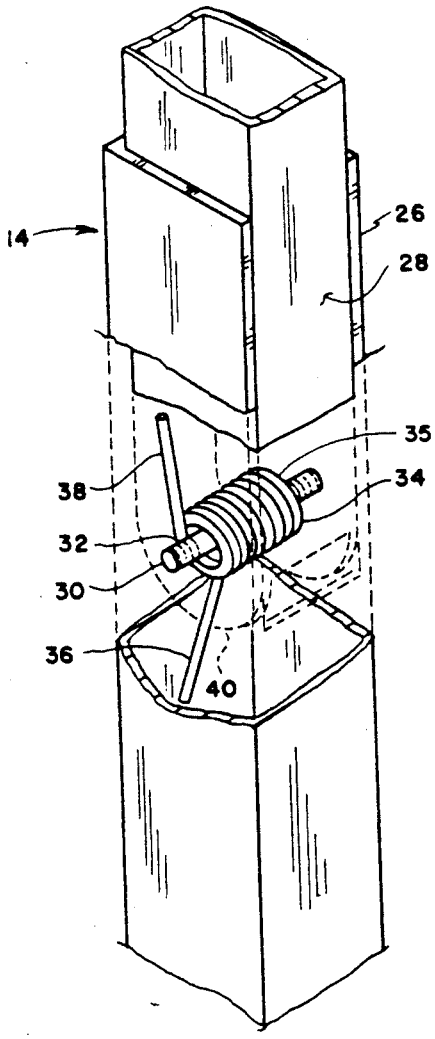
FIG. 2 is a pictorial view, partially cut away, showing a pivotable joint between portions of a mailbox post and a spring mechanism for biasing the upper portion upright.

Referring to FIG. 1 of the drawings, there is shown a mailbox 10 fixedly mounted on upper portion 12, which in turn is pivotally mounted on lower portion 14 of a mailbox post. The mailbox may have a conventional structure including an inverted U-shaped panel 16 forming its top and side, along with a flat bottom panel and a rear wall (not shown). Access to the box is provided by a door 18 at the front of the box pivotally secured by pins 20. The door has a handle 22 at its top that mates with a catch 24 secured to the top of the box. Lower portion 14 of the post is rigidly secured in vertical position by means such as having its bottom end set in concrete. Both portions of the post may be made of rectangular hollow tubing, with the lower portion being slightly larger to receive the upper one in overlapping region 26. This region has an open side 28 parallel to the front of the box, allowing the upper portion to be rotated forward. As shown in FIG. 2, a pivot pin 30 extending through apertures 32 in the upper portion and 34 in the lower portion is disposed at right angles to the length of the mailbox. Upon pulling the box in a forward direction, it moves forward and downward, rotating around the pivot pin. A coil compression spring 35 disposed around the axis of the pivot pin biases the upper portion to a normally upright position, the spring having radially extending arms 36 and 38 that engage back walls of the lower and upper portions, respectively. The spring is selected to have a strength such as to allow the box to be readily moved forward to a position where the front of the box may be brought into the window of a vehicle and to return to the box to its upright position when released. The lower end 40 of upper portion 12 is rounded off as required to prevent its making contact with the back wall of the lower portion when pulled forward.

To facilitate grasping the box for pulling it forward, a handle 40 (FIG. 1) in the form of a rigid metal rod may be provided, the handle projecting forward from the end of the box. A tail 42 in the form of a semi-flexible, partially stiffened, rope or the like and having a knob 44 at its outer end may be connected to the handle to further assist grasping and to provide for smoothly guiding the box back into an upright position against the action of the spring.

Figure 3:
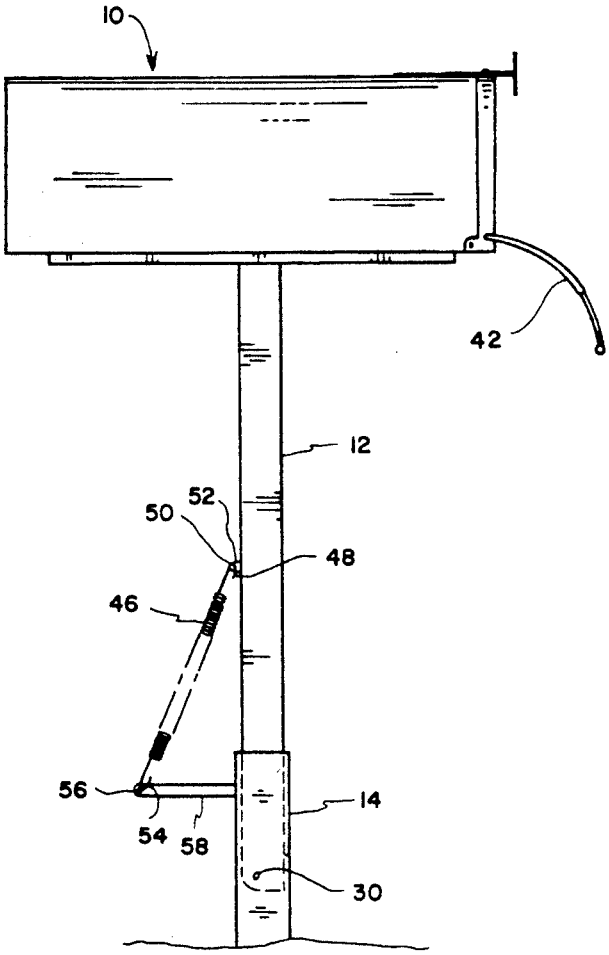
FIG. 3 is a pictorial view, partially cut away, showing an alternate spring mechanism.

FIG. 3 shows an embodiment using a different type of spring arrangement for biasing the box in an upright position. In this embodiment, a coiled tension spring 46 is mounted on the outside of the post so as to restrain movement of the box when it is pulled forward so that upper portion 12 pivots around pin 30. The spring is connected at its upper end by hook 48 engaging an aperture 50 in tab 52 secured to the back side of upper portion 12 and spaced apart upward from the top of lower portion 14. Hook 54 at the bottom end of the spring engages an aperture 56 at the outer end of a horizontally extending bracket 58 secured to the back side of lower portion 14 near its top. Strength of the spring is selected to normally hold the box in upright position and to enable it to be readily brought into tilted position.

Figure 4:
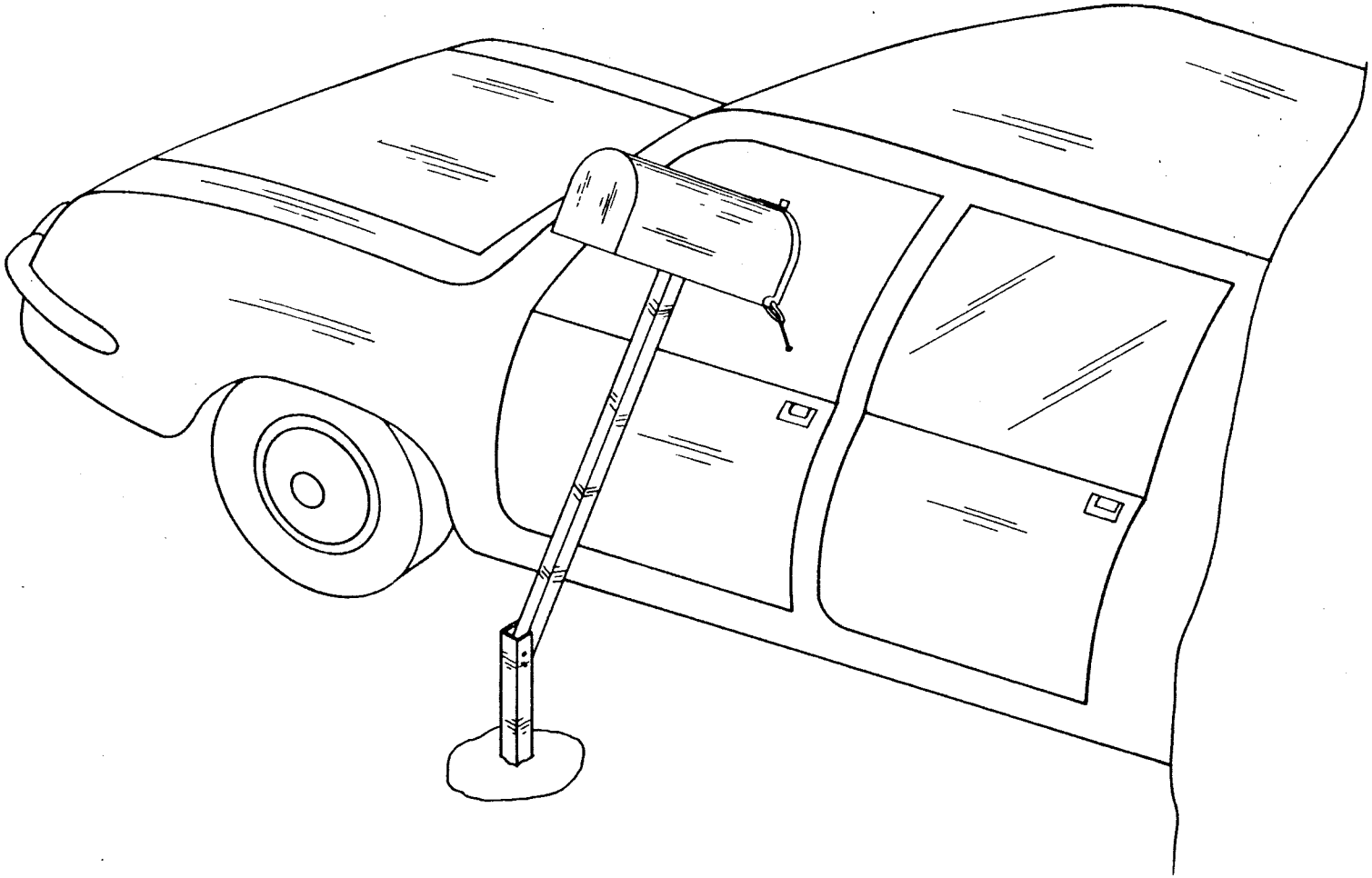
FIG. 4 is a pictorial view showing a mailbox deployed forward into an open window of a vehicle for retrieval of mail.

FIG. 4 shows a mailbox and post assembly with the box pulled forward into an open window 70 of a motor vehicle 72. The front end of the box extends inside the vehicle so that any mail that slides out upon opening the box does not fall to the ground but within the vehicle if it slips from the grasp of the rider. As shown in this view, the pin 30 around which the upper portion of the post rotates is located a relatively short distance, such as six inches, from ground level. This vertical location may be varied as required to enable the box in extended position to fit up to or within a window of a given type of vehicle without contacting and thus marring the vehicle door or body.

The invention is not to be understood as limited to the embodiments described above but is limited only as it is defined in the appended claims. In particular, other types of springs and variations such as use of posts having round or other cross-sectional shape may be employed.

I claim:

1. A rural mailbox and post assembly enabling the mailbox to be moved partially into an open window of a motor vehicle when spaced apart forward of the mailbox comprising:

a post including an upper portion and a lower portion:

said lower portion adapted to have its bottom end fixedly secured to a base in upright vertical position and its top end disposed substantially above said base;

said upper portion having a top end and a bottom end, said bottom end of said upper portion being pivotally secured to the top end of said lower portion and adapted to be moved from a normally upright position to a position wherein the top end of the post is inclined forward of said upright position;

said mailbox having a flat bottom panel, an inverted U-shaped panel forming its top and sides, a rear wall, and a front door pivotally mounted near the bottom thereof and being fixedly secured to said upper portion and disposed in a horizontal position when said upper portion is in upright position;

biasing means supporting said upper portion in a normally upright position and enabling said upper portion to be pulled forward against said biasing action;

pivot means connecting said bottom end of said top portion and said top end of said lower portion; and handle means.

2. An assembly as defined in claim 1 wherein said biasing means comprises spring means.

3. An assembly as defined in claim 2 wherein said pivot means comprises a pivot pin.

4. An assembly as defined in claim 2 including a graspable handle secured to and projecting forward from the front of said mailbox.

5. An assembly as defined in claim 3 wherein said post portions comprise tubing having a rectangular cross section, said lower portion being larger than said upper portion and having an open face portion on its forward face adjacent to its top end to enable nesting of the bottom end of said upper portion in the top end of said lower portion when said upper portion is disposed in upright position.

6. An assembly as defined in claim 3 wherein said spring means comprises a compression coil spring operably disposed around said pivot pin.

7. An assembly as defined in claim 3 including a horizontally extending bracket parallel to said box and secured to the outside of said lower portion near its top end and wherein said spring means comprises a tension spring operably secured at one end thereof to said bracket at a location spaced apart from said post and means securing the opposite end of said spring to said upper portion at a location spaced apart upward from the top end of said lower portion.

* * * * *